US005749127A

United States Patent [19]

Hsieh

[11] Patent Number: 5,749,127

[45] Date of Patent: May 12, 1998

[54] EASILY ADJUSTABLE FASTENING BELT FOR HOLDING A DIVE KNIFE

[76] Inventor: Hsing-Chi Hsieh, 1 Fl., No. 22, Lane 125, Jen Ai St., Sanchung City, Taipei Hsien, Taiwan

[21] Appl. No.: 869,123

[22] Filed: Jun. 4, 1997

[51] Int. Cl.[6] ..... A44B 11/00

[52] U.S. Cl. ..... 24/3.13; 24/170; 24/191; 24/194

[58] Field of Search ..... 24/3.13, 3.12, 24/168, 170, 191, 194, 616, 197

[56] References Cited

U.S. PATENT DOCUMENTS

| | | | |
|---|---|---|---|
| 0,379,078 | 3/1888 | Parker | 24/191 |
| 1,025,520 | 5/1912 | Douglass | 24/3.12 |
| 1,485,626 | 3/1924 | Printz | 24/3.13 |
| 3,091,830 | 6/1963 | Harley | 24/170 |
| 3,402,439 | 9/1968 | Currat | 24/194 |
| 5,170,539 | 12/1992 | Lundstedt et al. | 24/194 |

*Primary Examiner*—Victor N. Sakran
*Attorney, Agent, or Firm*—Pro-Techtor International

[57] ABSTRACT

An easily adjustable fastening belt for holding a dive knife including a belt and a male and a female fastening means separately connected to two ends of the belt. A length of the belt near the end having the female fastening means connected thereto is provided at an inner surface with a plurality of teeth. The female fastening means is provided at a body-facing side with a leaf spring member and at an outer side with a pivotally connected cover plate. The leaf spring has one end always pressing against a force-applying end of the cover plate, such that another end or a resistance end of the cover plate shall normally press against the toothed belt, so that the end of the belt with the female fastening means can only be pulled forward to tighten the belt around a wearer's leg. However, when the force-applying end of the cover plate is depressed, the resistance end of the cover plate immediately becomes disengaged from the toothed belt and allows the toothed belt to be pulled forward or backward, so that a tightness of the belt against the wearer's leg can be easily adjusted.

1 Claim, 2 Drawing Sheets

EASILY ADJUSTABLE FASTENING BELT FOR HOLDING A DIVE KNIFE

BACKGROUND OF THE INVENTION

The present invention relates to a fastening belt for holding a dive knife, and more particularly to a fastening belt for holding a dive knife which can be easily adjusted in its tightness against a wearer's leg.

A dive knife is usually carried by a diver or a submarine worker in case of any danger during a water activity or a submarine task. The dive knife is usually contained in a sheath which is held by a belt tightened around a wearer's leg. The belt must be so structured that it can be conveniently adjusted in its tightness against the wearer's leg. FIG. 1 illustrates a conventional fastening belt A for holding a sheath of dive knife. The fastening belt A includes a belt 10 having a buckle 20 connected to one end thereof. The buckle 20 has a spike 30. A plurality of holes 40 are formed along the other end of the belt 10. To use the fastening belt A, first extend the belt 10 through the sheath of dive knife, then wind the belt 10 around the wearer's leg and thread the other end of the belt 10 through the buckle 20 with the spike 30 going through one of the holes 40 to tighten the belt 10 with the dive knife around the wearer's leg. That is, to fasten or to loosen the above fastening belt A around or from the wearer's leg, the spike 30 must be threaded through or pulled out of one of the holes 40 on the belt 10. It will, of course, take time to do so and is not allowable in an emergent condition. It is therefore desirable to develop a fastening belt for holding a dive knife which can be easily and quickly adjusted in its tightness.

SUMMARY OF THE INVENTION

A primary object of the present invention is to provide a fastening belt for holding a dive knife that can be quickly tightened or loosened by a wearer. The fastening belt for holding a dive knife according to the present invention includes a belt and a male and a female fastening means separately connected to two ends of the belt. A length of the belt near the end having the female fastening means connected thereto is provided at an inner surface with a plurality of teeth. The female fastening means is provided at a body-facing side with a leaf spring member and at an outer side with a pivotally connected cover plate. The leaf spring has one end always pressing against a force application end of the cover plate, such that another end or a resistance end of the cover plate shall normally press against the toothed belt, so that the end of the belt with the female fastening means can only be pulled forward to tighten the belt around a wearer's leg. However, when the force-applying end of the cover plate is depressed, the resistance end of the cover plate immediately becomes disengaged from the toothed belt and allows the toothed belt to be pulled forward or backward, so that a tightness of the belt against the wearer's leg can be easily adjusted.

BRIEF DESCRIPTION OF THE DRAWINGS

The structure, the features, and the functions of the present invention can be best understood by referring to the following detailed description of the preferred embodiments and the accompanying drawings, wherein.

DETAILED DESCRIPTION OF THE PREFERRED EMBODIMENTS

Figure 1:
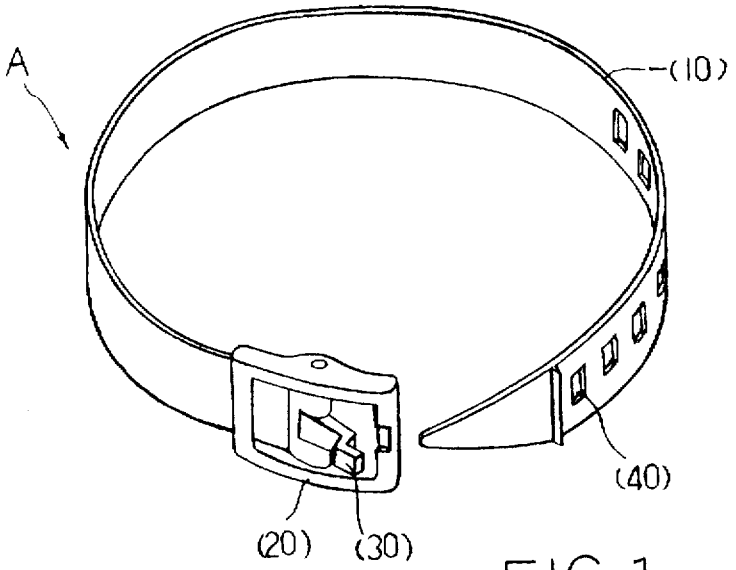
FIG. 1 (Prior Art)
FIG. 1 illustrates a conventional fastening belt for holding a dive knife.
Figure 2:
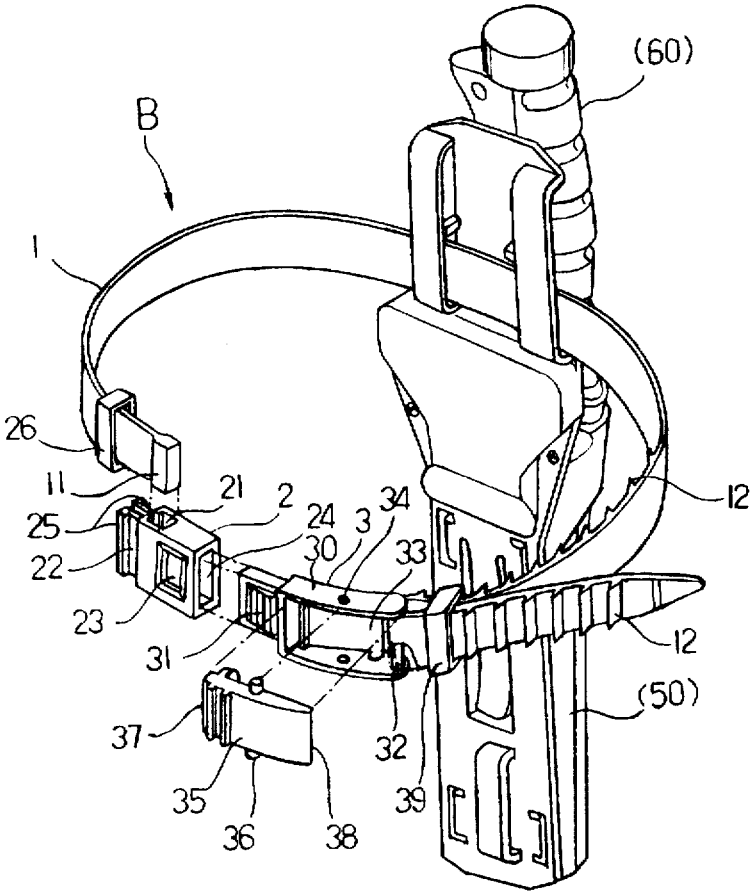
FIG. 2 is an exploded perspective of the fastening belt for holding a dive knife according to the present invention.

Please refer to FIG. 2. The present invention relates to a fastening belt B for holding a dive knife. The dive knife referred to hereinafter shall include a sheath of dive knife 50 and a dive knife 60 positioned in the sheath 50. The dive knife 60 is safely held in the sheath 50 by depressing a push button and can be drawn out of the sheath 50 by releasing the push button.

The belt B is so structured that it includes an adjustable belt 1 for holding the sheath of dive knife 50 thereto, a male festening means 2 attached to a first end of the belt 1, and a female fastening means 3 associated with a second end of the belt 1.

The first end of the belt 1 is formed with a belt head 11. A length of the belt 1 near the second end thereof is provided at an inner surface with a plurality of parallel teeth 12 transversing a width of the belt 1.

The male fastening means 2 includes a first hole 21 formed at one end of the male fastening means 2 to fitly receive the belt head 11 therein. Two legs extending from one side of the first hole 21 to form a clamping means 22. Outer ends of the two legs of the clamping means 22 are formed with two stopping flanges 25. The male fastening means 2 also has a second hole 23 formed at an outer wall surface of the male fastening means 2 and a third hole 24 formed at another end of the male fastening means 2 opposite to the first hole 21 and communicable with the second hole 23. A first loop 26 is located between the stopping flanges 25 and the first hole 21 of the male fastening means 2 to encircle the clamping means 22, so that the first fastening means 2 is firmly associated with the belt head 11.

Figure 3:
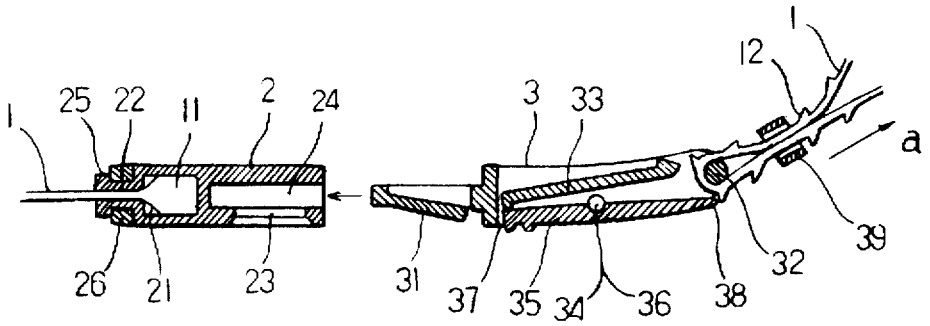
FIG. 3 is a fragmentary sectional view showing the relation between the two fastening means of the present invention.
Figure 4:
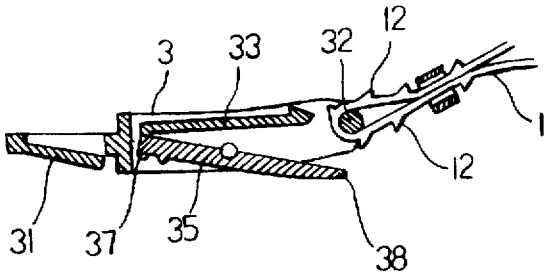
FIG. 4 is is a fragmentary sectional view showing a force-applying end of a cover plate of one fastening means of the belt is depressed.

Please refer to FIGS. 2, 3 and 4 at the same time. The female fastening means 3 includes a frame body 30. An inclined spring plate 31 extending from a front end of the frame body, that is, an end of the frame body facing the male fastening means 2, for sliding into the third hole 24 of the male fastening means 2 and being retained thereto by engaging into the second hole 23 of the male fastening means 2. A round bar 32 is provided across another end of the frame body opposite to the inclined spring plate 31, so that the second end of the belt 1 can be extended to pass by and turned about at the round bar 32 and is secured to the belt 1 again by a second loop 39.

The female fastening means 3 is provided near its back side, that is, a body-facing side, with a leaf spring 33, and at its upper and lower frames with two pivotal holes 34 to receive two opposite pivotal shafts 36 of a cover plate 35, so that the cover plate 35 is pivotally connected to a front or outer side of the female fastening means 3 opposite to the leaf spring 33.

One end of the cover plate 35 is a force-applying end 37 and the other end of the cover plate 35 is a resistance end 38. One end of the leaf spring 33 is normally pressing against the force-applying end 37 of the cover plate 35, so that the resistance end 38 of the cover plate 35 always presses against a portion of the belt 1 turning about at the round bar 32, permitting the toothed belt 1 to be pulled in only one direction as indicated by the arrow a to pass the round bar 32 and the resistance end 38 of the cover plate 35 without the possibility of being pulled in a reverse direction to loosen the belt 1. By this way, the belt 1 can be tightened around a wearer's leg. To loosen the belt 1, simply depress the force-applying end 37 of the cover plate 35 toward the leg, causing the resistance end 38 to disengage from the round bar 32 and the belt 1. At this point, the teeth 12 on the belt 1 are no longer stopped by the resistance end 38 of the cover plate 35 and the belt 1 can therefore be pulled in the reverse direction to quickly adjust its tightness against the wearer's leg.

To quickly wear the fastening belt of the present invention around a leg, the wearer needs only to insert the spring plate 31 of the female fastening means 3 into the second hole 23 of the male fastening means 2. And, to untie the fastening belt B, the wearer needs only to disengage the spring plate 31 from the second hole 23 of the male fastening means 2. The fastening belt B according to the present invention is very convenient in use and can be easily and quickly adjusted in its tightness against the wearer's leg by depressing the force-applying end of the cover plate of the female fastening means and pulling the belt 1 forward or backward.

What is claimed is:

1. An easily adjustable fastening belt for holding a dive knife, comprising a belt holding a sheath of dive knife, a male fastening means attached to a first end of said belt, and a female fastening means associated with a second end of said belt;

said first end of said belt being formed with a belt head, and a length of said belt near said second end thereof being provided at an inner surface with a plurality of parallel teeth transversing a width of said belt;

said male fastening means being formed at one end with a first hole to fitly receive said belt head therein, at an outer side wall surface with a second hole, and at another end opposite to said first hole with a third hole which is communicable with said second hole; two legs with stopping flanges formed at outer ends extending from one side of said first hole facing said belt head to form a clamping means, a first loop being located between said stopping flanges and said first hole to encircle said clamping means, firmly associating said male fastening means with said belt head at said first end of said belt; and said female fastening means including a frame body, an inclined spring plate extending from an end of said frame body facing said male fastening means for sliding into said third hole of said male fastening means and being retained thereto by engaging into said second hole of said male fastening means, a round bar extending across another end of said frame body opposite to said inclined spring plate, such that said second end of said belt can be extended to pass through and turn about at said round bar and be secured to said belt again by a second loop, a leaf spring provided near a body-facing side of said frame body, and a cover plate pivotally connected to a front or outer side of said frame body opposite to said leaf spring; wherein one end of said leaf spring being normally pressing against a force-applying end of said cover plate near said inclined spring plate, so that another resistance end of said cover plate near said round bar always presses against a portion of said belt turning about at said round bar and closes the front side of said frame body;

whereby when said cover plate of said female fastening means presses said resistance end against said belt turning about at said round bar, said toothed second end of said belt can be pulled forward only in one direction to pass through said resitance end of said cover plate without the possibility of being pulled backward and thereby the fastening belt for holding the dive knife can be tightened around a wearer's leg, and when said force-applying end of said cover plate is depressed, said resistance end of said cover plate immediately becomes disengaged from said belt turned about at said round bar, allowing said toothed second end of said belt to be quickly pulled backward to adjust its tightness against the wearer's leg.

* * * * *